United States Patent [19]

Catena

[11] Patent Number: 4,716,839

[45] Date of Patent: Jan. 5, 1988

[54] TROLLEY FOR THE OVERHEAD TRANSPORTATION OF LOADS ON MONORAIL

[75] Inventor: Nicola Catena, Leumann, Italy

[73] Assignee: Fata European Group S.p.A., Torino, Italy

[21] Appl. No.: 857,185

[22] Filed: Apr. 29, 1986

[30] Foreign Application Priority Data

May 23, 1985 [IT] Italy ..... 21923/85[U]

[51] Int. Cl.[4] ..... B61B 3/02

[52] U.S. Cl. ..... 105/153

[58] Field of Search ..... 104/93, 119; 105/150, 105/152, 153, 156

[56] References Cited

U.S. PATENT DOCUMENTS

| | | | |
|---|---|---|---|
| 3,129,671 | 4/1964 | Vanderbeck | 105/153 |
| 3,625,158 | 12/1971 | Lorenz et al. | 104/93 |
| 3,902,432 | 9/1975 | Shortridge et al. | 105/150 |
| 4,164,187 | 8/1979 | Kaufmann | 104/93 |
| 4,480,157 | 10/1984 | Ishikura et al. | 104/93 X |
| 4,644,873 | 2/1987 | Uttscheid | 104/93 |

*Primary Examiner*—Robert B. Reeves
*Assistant Examiner*—Thomas W. Kearns
*Attorney, Agent, or Firm*—Stevens, Davis, Miller & Mosher

[57] ABSTRACT

A trolley for the overhead transportation of loads on a monorail consisting of a framework comprising: a pair of sides (11) which are rigidly interconnected in their upper portion by a pair of respectively front and rear flanges (12) and, in their lower portion, by a bracket (13) carrying a bar (19) for suspending a load. There is pivoted between the flanges (12) through the intermediary of a pivot (15) a wheel (16) serving to translate the trolley on a monorail (18). It is also possible to pivot guide wheels (20) cooperating with the monorail (18) so as to achieve a stable guidance of the trolley on it.

1 Claim, 4 Drawing Figures

TROLLEY FOR THE OVERHEAD TRANSPORTATION OF LOADS ON MONORAIL

The present invention relates to an improved trolley for the overhead transportation of loads on a monorail.

As is well-known to persons skilled in the art, trolleys of this kind are structurally formed of a framework mounted on a guide rail by means of a series of running wheels, at least one of which must be operationally connected to an actuating drive unit attached to the said framework. The said framework is also provided in its lower portion with a suitable means for suspending the load that is to be transported. The trolleys of the kind in question currently in use are relatively complicated and costly to construct, if they are to be multi-purpose, on account of the very large number of components of which they are composed. They do not, however, lend themselves to any great flexibility of use since they are not readily adaptable to variations in the run, increases of loads to be transported or in any case to changes in the condition of load. In addition, when replacement parts are fitted, the replaced parts are not easy to re-use.

It should more particularly be noted that a transportation system of the overhead kind is normally designed for level runs. However, ascending and/or descending sections can at later dates be inserted into such runs.

As is known, such ascending or descending runs can be overcome either with the aid of a complementary train to assist in overcoming the difference in height, to which the trolley is connected, or by replacing the original drive unit of the trolley, if inadequate, by one of greater power which is also provided with means that assure not only the requisite adherence in the presence of relatively steep slopes but also a stable trim of the trolley in the different service conditions, i.e. climbs, descents and bends.

Another known system for overcoming differences in height of runs covered by overhead transportations lines is to make a section of the route mobile in the vertical direction, by means of an elevator device. Both the systems described above are clearly very costly. The object of the present invention is to obviate the drawbacks of the known art as mentioned heretofore by embodying a trolley which consists structurally of a limited number of basic components that are readily assembled and which can be converted or added to over time, so as to obtain combinations that will satisfy a very wide variety of operational requirements.

To achieve this object the present invention embodies a trolley for the overhead transportation of loads on a monorail, characterized in that it consists of a framework which comprises, in combination: a pair of sides (11) which are rigidly interconnected in their upper portion by a pair of respectively front and rear flanges (12), and in their lower portion by a bracket (13) bearing a means (19) from which to suspend a load, there being pivoted between the flanges (12) through the intermediary of a pivot (15) a wheel (16) serving to translate the trolley on a monorail (18), it being also possible guide wheels 20 of pivot to the flanges (12) and the bracket (13) cooperating with the monorail (18) so as to achieve a stable guidance of the trolley on it.

The structural and functional characteristics of the invention and its advantages will become more apparent from an examination of the following description referred to the appended drawings, in which.

Figure 1:
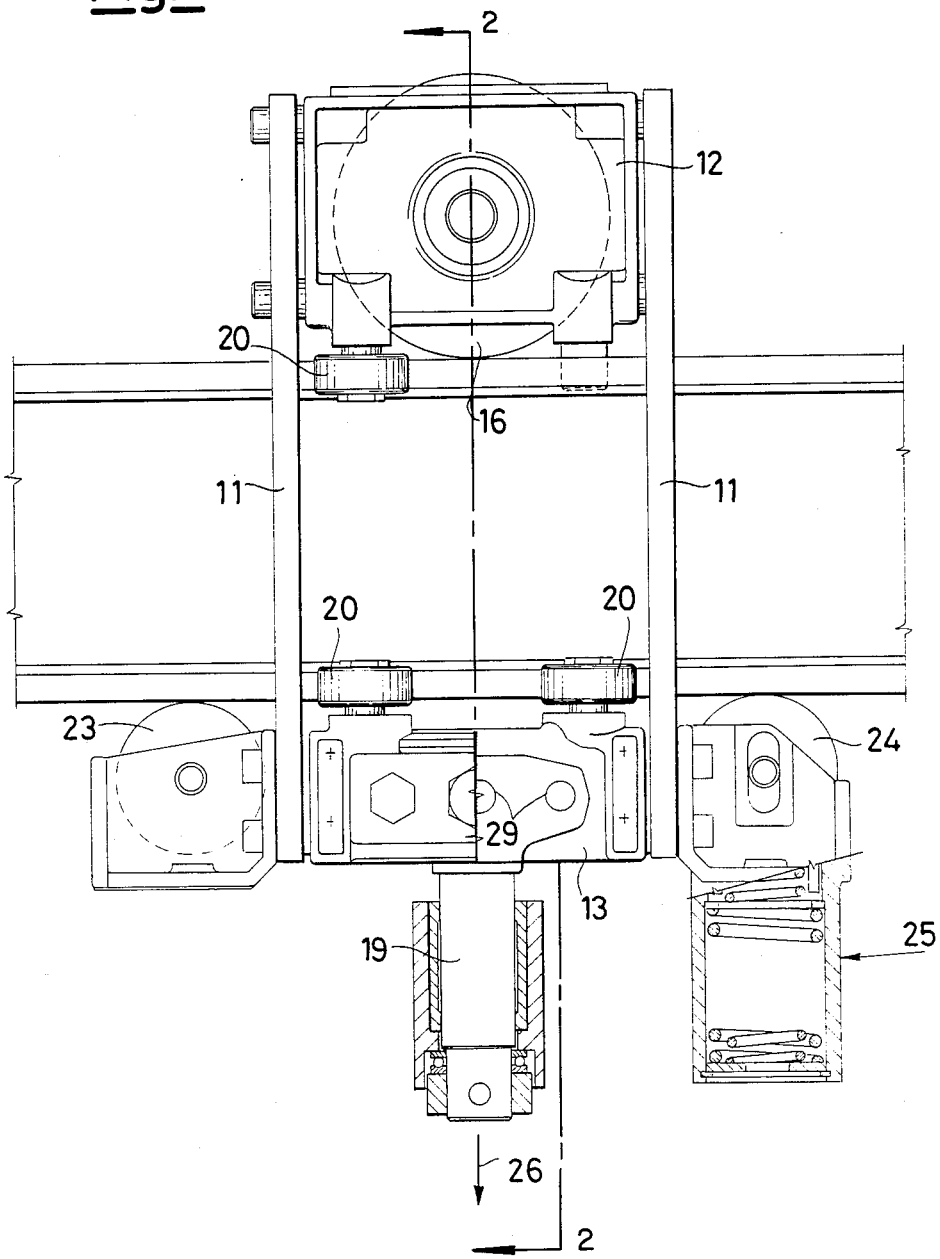
FIG. 1 is a front elevation, partially sectioned, showing an example of a base-trolley modulus incorporating the principles of the basic invention.

The trolley embodied according to the present invention is indicated overall by 10 and consists structurally of a pair of sides 11, which are in their upper portion interconnected by bolting a pair of flanges 12, duly spaced, and in their lower portion by a bracket 13.

Between the flanges 12, on bearings 14, there is mounted a pivot 15 to which is keyed a wheel 16 which translates on the upper flange 17 of an "I"-profiled girder 18, which forms the monorail of the overhead transport system.

To the bracket 13, on the other hand, there is restrained a bar 19 which serves for suspending the load, as will be later explained herein in greater detail.

The flanges 12 and the bracket 13 also carry guide wheels 20 cooperating with the edges of the flanges of the girders 18, the girder 18 being supported by interspaced support brackets 21.

The trolley briefly described above is the essence of the present invention and represents the basic modulus which lends itself to have mounted thereon additional units and components so as to realize a more complex powered apparatus for the overhead transportation of loads.

Figure 2:
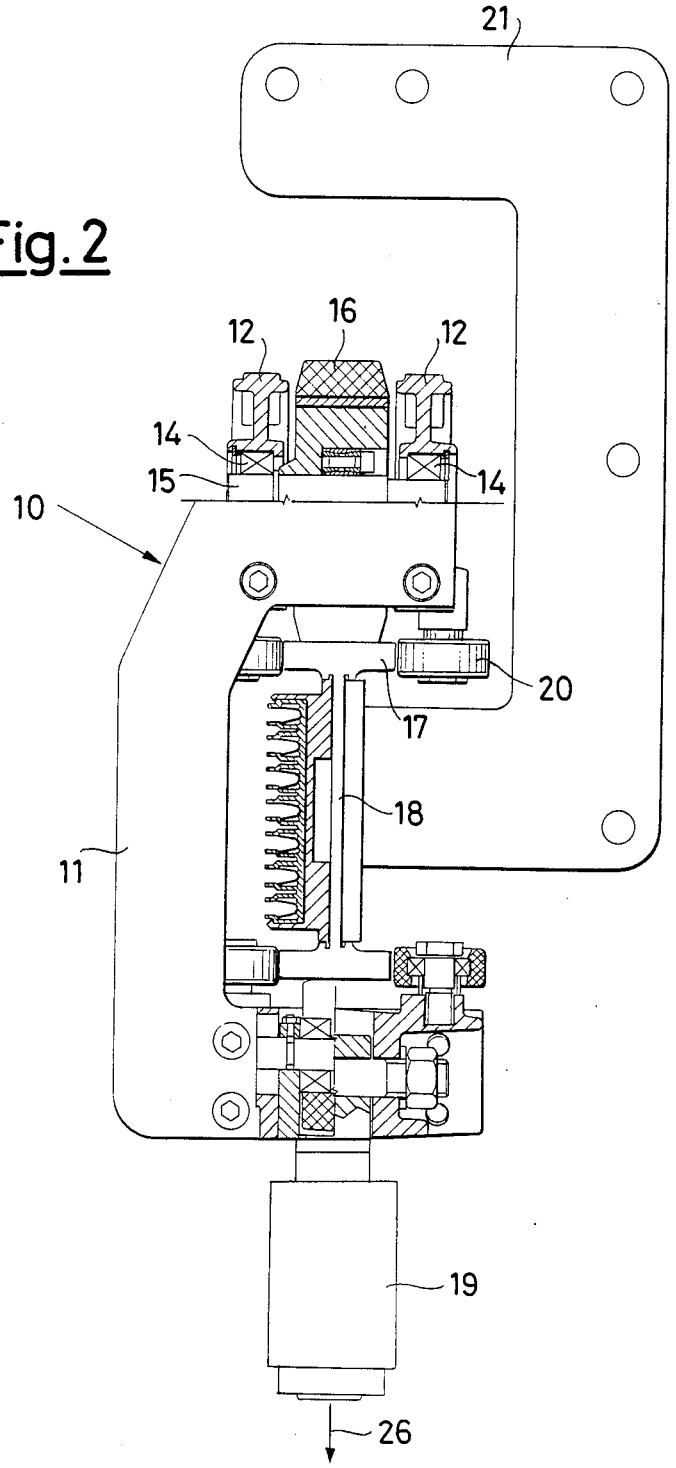
FIG. 2 is a section taken on the line II—II in FIG. 1.
Figure 3:
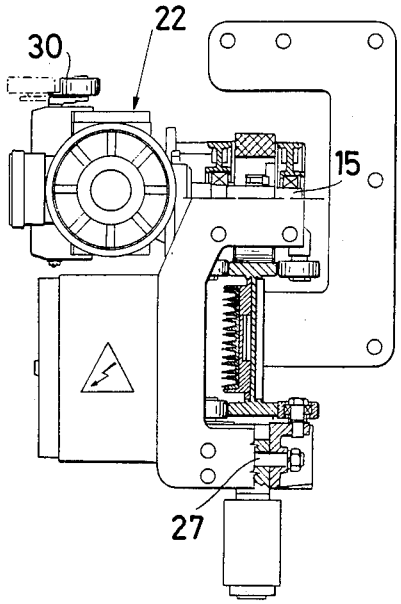
FIG. 3 is a view of the basic trolley in FIGS. 1 and 2 equipped with a drive unit.

For example, there can be connected to the pivot 15 a geared motor indicated overall by 22, which is attached to the front flange (FIG. 3) if necessary with the interposing of an adaptor; while on the bracket 13 there can be laterally mounted a pair of wheels 23, 24 cooperating with the wheel 16, in order to assure a stable translation of the powered trolley on the monorail, even in the presence of sloping sections. To this end, one of the two wheels 23, 24 is a floating wheel and is pressed by a pressor unit 25 against the lower flange of the girder 18, while the other wheel is a reacting wheel (FIGS. 1 and 2).

Figure 4:
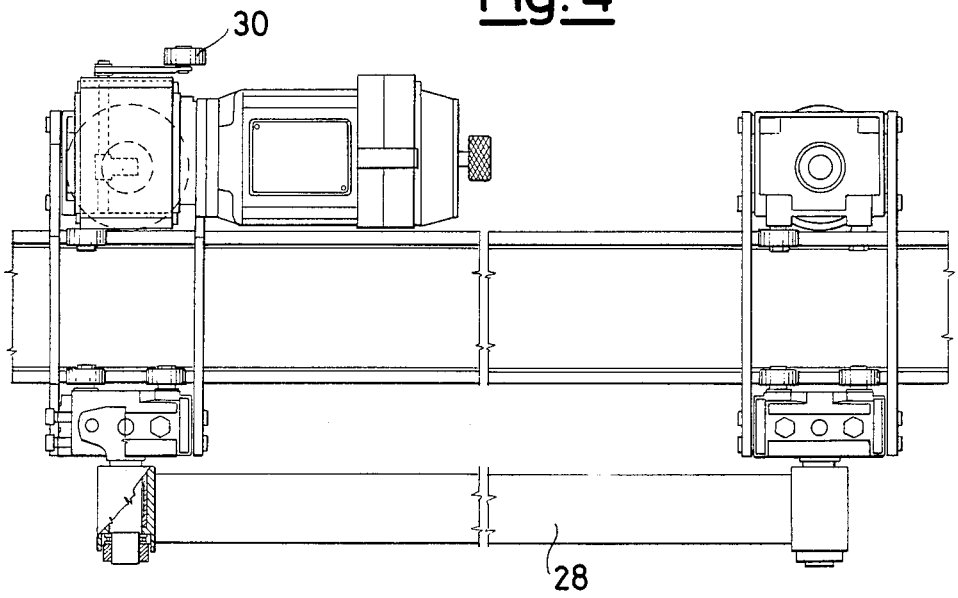
FIG. 4 shows a combination of the powered trolley in FIG. 3 with a driven basic trolley.

The aforesaid wheels 23, 24 need not of course be included if two trolleys 10 intended to run a level course are coupled (FIG. 4). There is in this way a powered apparatus that can transport a load, shown schematically by the arrow 26, which is restrained to the bar 19. In such case, the bar 19 can be pivoted centrally at 27 to the lower bracket 13.

For the transporation of very heavy loads, the basic modulus (non-powered trolley) can be associated with the aforesaid powered apparatus.

As FIG. 4 clearly shows, such addition is readily, simply and rapidly made, even after a lengthy period of time, through the intermediary of a rigid connecting girder 28 attached to the bars 19. In this case, instead of the bars (19) being centrally pivoted they can be rigidly bolted laterally to the respective brackets 13.

For this purpose, the bars 19 and brackets 13 feature three matching bores 29 for the reciprocal connection, either articulated or simple depending on operational requirements, both in a single trolley and in two interconnected trolleys.

It is worthy of note that between the pivot drive unit 22 provision can also be made for a disengageable connection joint capable of making the wheel 16 an idle wheel.

This joint can be engaged and disengaged by suitable means, both manually and for example by means sensitive to the action of cam operated means (not shown) on a sensor 30.

I claim:

1. A trolley for the overhead transportation of loads on a monorail, characterized in that it consists of a framework comprising, in combination: a pair of sides (11) which are rigidly interconnected in their upper portion by a pair of spaced flanges (12) and, in their lower portion, by a bracket (13) carrying a means (19) for suspending a load, a pivot (15) mounted between said flanges (12), a drive wheel (16) mounted on said pivot (15) servable to translate the trolley on a monorail, wheels (20) pivotally mounted on said flanges (12) and the bracket (13) cooperatable with said monorail so as to achieve a stable guidance of the trolley on said monorail, a first supporting wheel (23) fixedly mounted on said bracket (13) cooperatable with the bottom of said monorail, a second supporting wheel (24) floatably mounted on said bracket and cooperatable with the bottom of said monorail, a pressure unit (25) mounted on said bracket to force and maintain said second supporting wheel against the bottom of said monorail so as to assure a stable trim of the trolley moving on said monorail, and a geared motor (22) attached to one of said flanges (12) and operationally connected to said pivot (15) to move said drive wheel (16).

* * * * *